US010299351B2

(12) United States Patent
Bovino

(10) Patent No.: US 10,299,351 B2
(45) Date of Patent: May 21, 2019

(54) LED LIGHTING INCORPORATING DMX COMMUNICATION

(71) Applicant: Michael Bovino, Cherry Hill, NJ (US)

(72) Inventor: Michael Bovino, Cherry Hill, NJ (US)

( * ) Notice: Subject to any disclaimer, the term of this patent is extended or adjusted under 35 U.S.C. 154(b) by 20 days.

(21) Appl. No.: 15/301,617

(22) PCT Filed: Apr. 3, 2015

(86) PCT No.: PCT/US2015/024323
§ 371 (c)(1),
(2) Date: Oct. 3, 2016

(87) PCT Pub. No.: WO2015/154015
PCT Pub. Date: Oct. 8, 2015

(65) Prior Publication Data

US 2018/0199413 A1 Jul. 12, 2018

Related U.S. Application Data

(60) Provisional application No. 61/974,507, filed on Apr. 3, 2014, provisional application No. 62/013,258, filed on Jun. 17, 2014, provisional application No. 62/093,470, filed on Dec. 18, 2014.

(51) Int. Cl.

| | |
|---|---|
| ***H05B 37/02*** | (2006.01) |
| ***H05B 33/08*** | (2006.01) |
| ***F21V 23/00*** | (2015.01) |
| ***F21K 9/278*** | (2016.01) |

(52) U.S. Cl.
CPC ..... *H05B 37/0254* (2013.01); *F21K 9/278* (2016.08); *F21V 23/003* (2013.01); *H05B 33/0857* (2013.01)

(58) Field of Classification Search
None
See application file for complete search history.

(56) References Cited

U.S. PATENT DOCUMENTS

2005/0030744 A1* 2/2005 Ducharme ..... H05B 33/0857 362/231
2007/0228999 A1* 10/2007 Kit ..... H05B 33/0803 315/291
2010/0190455 A1* 7/2010 Hashizume ..... H05B 33/0803 455/90.3
2010/0327766 A1* 12/2010 Recker ..... H02J 7/025 315/291
2011/0043136 A1* 2/2011 Radermacher ..... H05B 33/0806 315/294
2011/0103049 A1 5/2011 Kubis
2011/0175510 A1* 7/2011 Rains, Jr. ..... C09K 11/574 313/32

(Continued)

*Primary Examiner* — Crystal L Hammond
(74) *Attorney, Agent, or Firm* — Fox Rothschild LLP

(57) ABSTRACT

A light emitting diode (LED) lighting fixture includes a lamp having a tube with at least one LED lamp positioned therein and operatively connected with external electrical contacts. The lamp has at least one communication protocol address associated therewith. A communication protocol converter is associated with the lamp and is configured to receive an instruction from a communication protocol controller, determine if the instruction is intended for the associated at least one communication protocol address, and if so, control the at least one LED lamp based on the instruction.

24 Claims, 6 Drawing Sheets

(56) References Cited

U.S. PATENT DOCUMENTS

| | | | | |
|---|---|---|---|---|
| 2012/0236554 | A1* | 9/2012 | Rust | H05B 33/0857 362/231 |
| 2012/0271477 | A1* | 10/2012 | Okubo | H04L 12/10 700/297 |
| 2013/0003380 | A1 | 1/2013 | Cao et al. | |
| 2013/0044476 | A1* | 2/2013 | Bretschneider | F21V 29/70 362/235 |
| 2013/0293123 | A1 | 11/2013 | Deak, Sr. et al. | |
| 2013/0301274 | A1* | 11/2013 | Anderson | F21V 29/505 362/294 |
| 2014/0049164 | A1* | 2/2014 | McGuire | H05B 33/08 315/149 |
| 2014/0177203 | A1* | 6/2014 | Novak | F21S 8/036 362/95 |
| 2015/0003053 | A1* | 1/2015 | Ariyoshi | F21V 23/0471 362/223 |
| 2015/0061541 | A1* | 3/2015 | Gandini | H05B 37/0272 315/294 |
| 2015/0163881 | A1* | 6/2015 | Pederson | H05B 33/0863 315/154 |
| 2016/0278186 | A1* | 9/2016 | Van De Sluis | H05B 33/0863 |

* cited by examiner

LED LIGHTING INCORPORATING DMX COMMUNICATION

CROSS-REFERENCE TO RELATED APPLICATIONS

This application is the U.S. National Phase of International Patent Application No. PCT/2015/024323, filed Apr. 3, 2015, which claims priority to U.S. Provisional Patent Application Nos. 61/974,507, filed Apr. 3, 2014, 62/013,258, filed Jun. 17, 2014 and 62/093,470, filed Dec. 18, 2014. The disclosure of all applications are hereby incorporated by reference in their entirety.

STATEMENT OF THE TECHNICAL FIELD

The present disclosure relates to light emitting diode (LED) lamps. More specifically, the present disclosure relates to LED lamps, lighting tubes and fixtures that incorporate digital communications.

DESCRIPTION OF THE RELATED ART

Conventional lighting technology for large buildings such as office buildings, schools, recreational centers, retail establishments, theme parks and other similar structures are typically fluorescent fixtures including fluorescent lamps. Fluorescent lamps are more durable, economical and efficient when compared to incandescent lamps, and thus became standard for many lighting applications.

Typical fluorescent lighting fixtures include one or more ballasts for converting input or source power into power usable by the fluorescent lamps. A typical fluorescent lamp may have a standard socket size, tube diameter and length (e.g., a T8 lamp having a one inch tube diameter and a four foot length—many others are available).

In light of recent energy conservation efforts and improved designs, one common occurrence is replacing existing fluorescent lamps with similarly shaped and rated LED lamps. By using existing technology, LED lamps can be made to closely match the functionality and appearance of fluorescent lamps.

Additionally, many existing lighting installations utilize DMX communications and protocols for providing an interactive lighting experience. For example, recreational facilities such as bowling centers, theme parks and stage productions utilize DMX communications to provide interactive sound and visual effects for patrons.

It would be advantageous to provide an LED lamp that functionally and visually replaces existing fluorescent lighting while also providing for an interactive DMX controlled lighting experience.

BRIEF DESCRIPTION OF THE DRAWINGS

Embodiments will be described with reference to the following drawing figures, in which like numerals represent like items through the figures, and in which.

DETAILED DESCRIPTION

This disclosure is not limited to the particular systems, devices and methods described, as these can vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

The present disclosure relates to a modification of existing lighting fixtures, or implementation of new lighting fixtures, that utilize LED lamps as well as digital communications to provide lighting effects for interactive lighting experiences such as those commonly used at recreational facilities such as, for example, themed environments and bowling centers. As used in this document, digital multiplex (DMX) refers to the DMX512 standard protocol for digital communication networks. A DMX universe refers to a DMX network including, for example, up to 512 links or individual controllable devices. Depending upon the design, a DMX controller may be configured to provide operation control to one or more universes. Although described in this document in reference to DMX, one of ordinary skill in the art will recognize that other communications protocols, including but not limited to attached resource computer network (ARCnet), Ethernet (IEEE 802 protocols), infrared (IR), serial communications, and the like, may be used without departing from the spirit of this disclosure.

A typical DMX network may include, for example, one or more DMX controllers configured to produce one or more instructions (each of which has at least one associated address) and various effect devices such as, for example, lighting fixtures, fog machines, intelligent lights, audio output devices, and other similar effects devices. Each device within the network may include an associated address and be operably connected to the DMX controller for receiving the instructions from the DMX controller. The individual device may include a DMX converter that determines if the instruction is for that specific device as well as what particular effect to perform.

Figure 1:
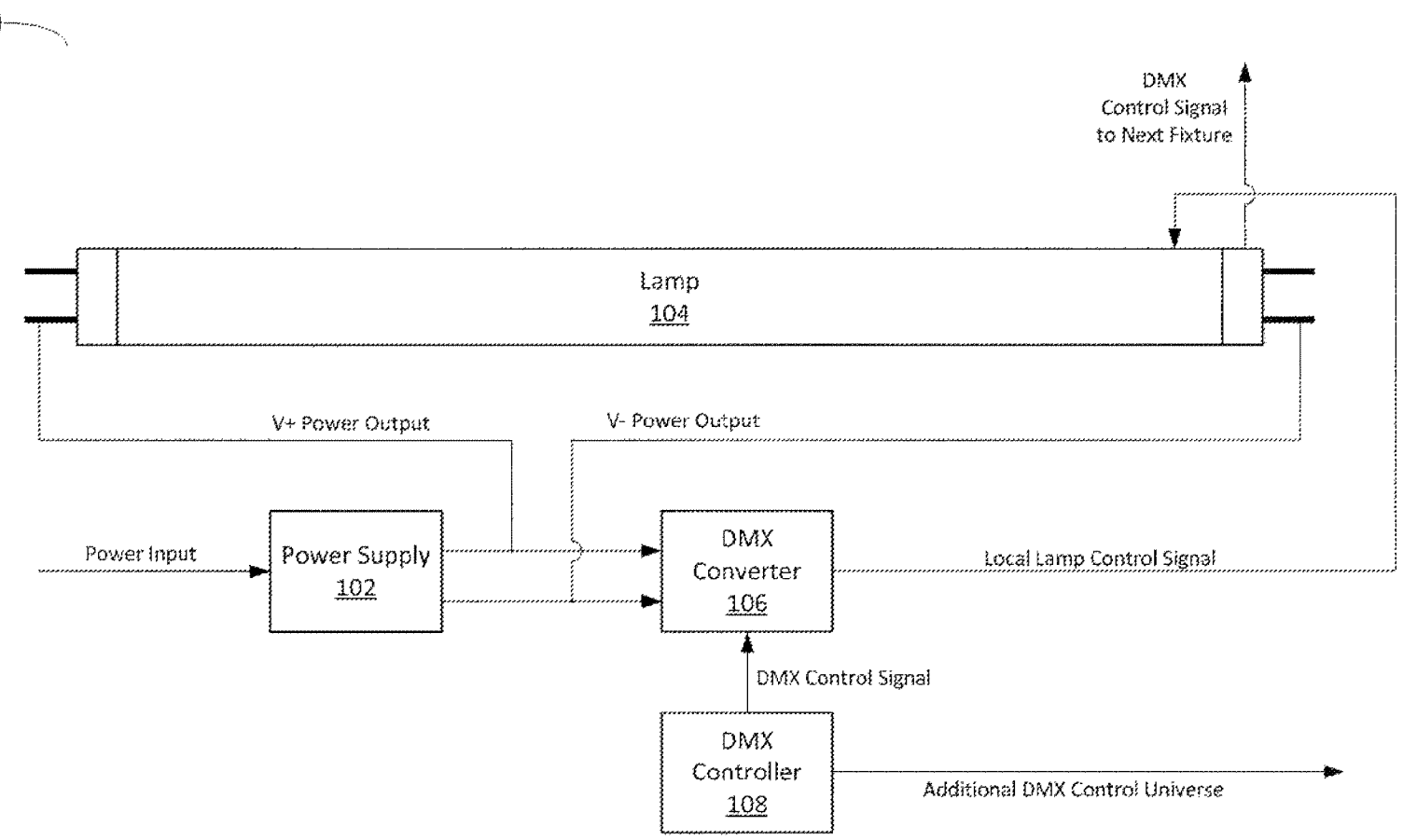
FIG. 1 depicts a first system diagram for a lighting fixture including an LED tube and DMX communication according to an embodiment.

FIG. 1 depicts a diagram illustrating a lighting fixture system 100 according to an embodiment. The lighting fixture system 100 may include, for example, a power supply 102, a lamp 104, a DMX converter 106 and a DMX controller 108. Depending upon the arrangement of the components, the power supply 102, lamp 104 and DMX converter 106 may be integrated into a single lighting fixture, and DMX controller 108 may be a processing device such as a server located at a remote location and configured to provide a DMX control signal to one or more fixtures. Similarly, the DMX controller 108 may be configured to output additional control for other DMX universes according to standard DMX protocol and operations. Additionally, depending upon the installation of the lighting fixture, lamp 104 may be, for example, a red, blue and green (RGB) LED lamp or a red, blue, green and white (RGBW) LED lamp. However, it should be noted that RGB and RGBW lamps are shown by way of example only, and the lamps as described herein may include additional types of LED lamps. For example, the lamps may include red(R), green(G), blue(B), white(W), ultra-violet(UV), amber (A) and infrared (IR). The possible combinations are lamps containing individual colors or wavelengths such as R, G, B, W, UV, IR, A, and the like, and combinations thereof, including, but not limited to, RGB, RGB-W, RGB-UV, RGB-IR, RGB-A, RGB-W-UV, RGB-W-IR, RGB-W-A, RGB-UV-IR, UV-IR, W-UV, W-IR, W-A, W-UV-IR, RGB-UV-IR-W, RGB-A-IR-W or any other combination. The infrared LEDs are used to illuminate areas with infrared light. The infrared light is used by most camera systems. Infrared light, which spans from 700 nanometers (nm) up to about 1000 nm, is beyond what the human eye can see, but most camera sensors can detect it and make use of it. This is particularly helpful with bowling scoring systems, tracking camera systems and security systems where there is minimal lighting available.

The DMX controller 108 may also be configured to control the DMX mode which allows each light to set the number of pixels/segments of LEDs to be controlled independently at one time. The pixels/segments, or quantity of LEDs, is associated with the number of DMX channels used. The higher number of DMX channels used per tube, the smaller the segment of LEDs controlled at one time. Conversely, the smaller number of DMX channels used the greater number of LEDs controlled or larger the segment size operated at one time. Selectable DMX modes are set when the light tube is addressed. Fixed light tube DMX modes are set when the tube is manufactured. For example: A T8 48" length light tube may have 72 tri-color RGB LEDs in it. Each tri-color LED would use three DMX channels so the entire light tube would use 216 DMX channels. If the fixture is used in the 24 channels mode, the LED segment size would be three DMX channels. So three tri-color LEDs would be controlled by each DMX address. In three channel mode, all of the seventy-two tri-color LEDs would operate together. So the tube would operate with three colors (Red, Green, Blue). Color mixing of these three colors produces 16.7 million colors. The number of colors available through color mixing depends on the number and combinations of LEDs used. Many versions of the tubes are contemplated so several different DMX modes are available.

Figure 2:
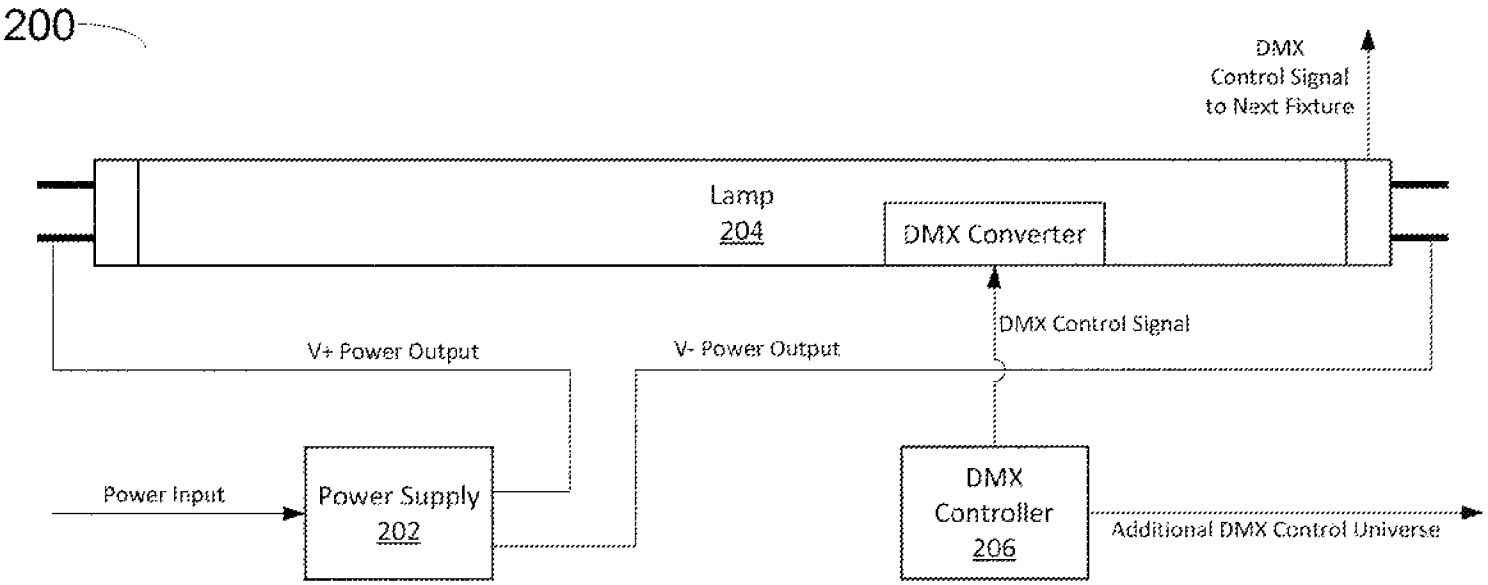
FIG. 2 depicts a second system diagram for a lighting fixture including an LED tube and DMX communication according to an embodiment.
Figure 3:
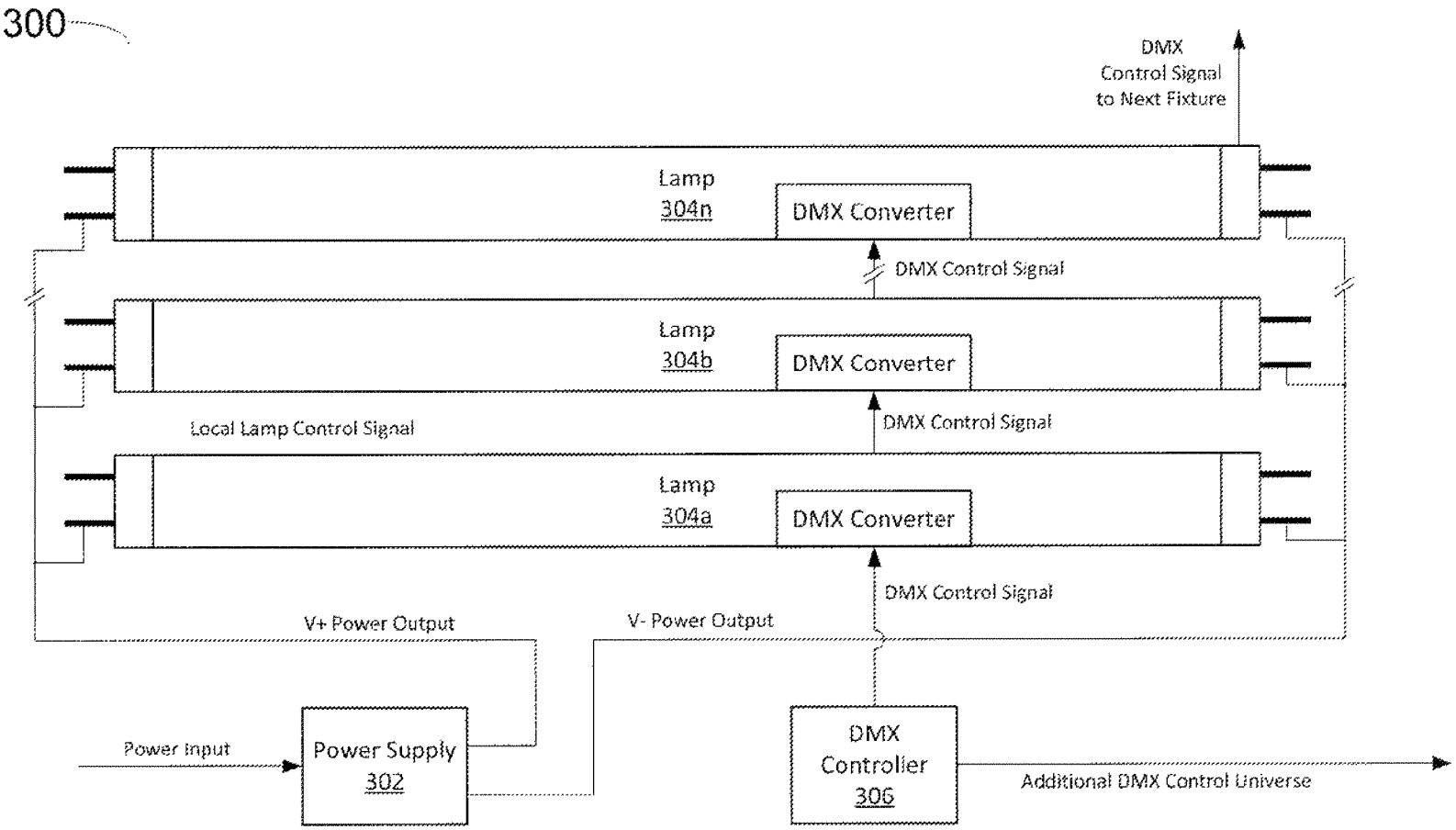
FIG. 3 depicts an alternative fixture as that shown in FIG. 2 including multiple LED lamps according to an embodiment.
Figure 4:
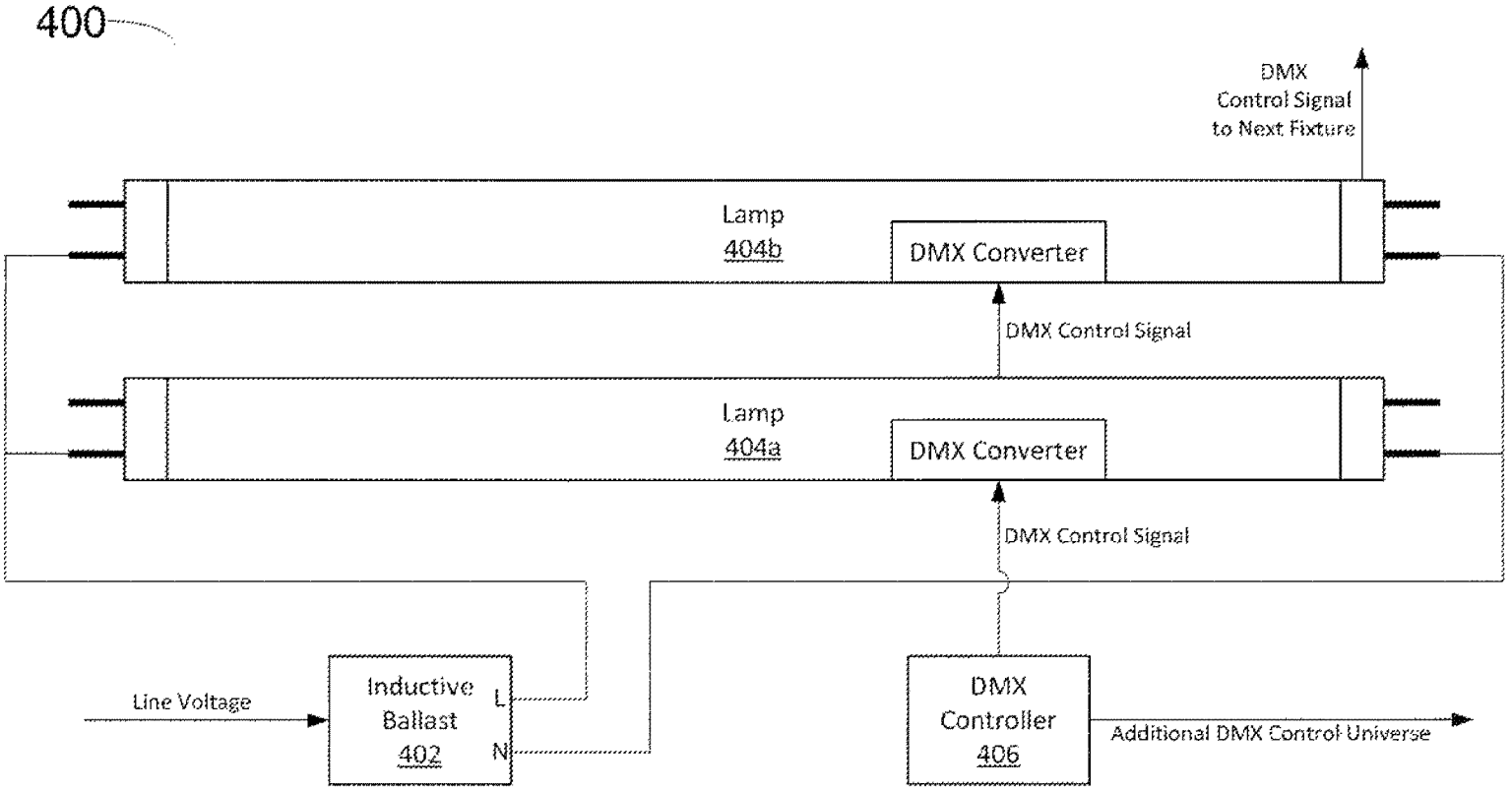
FIG. 4 depicts a third system diagram for a lighting fixture including an LED tube and DMX communication according to an embodiment.

As shown in FIG. 1, the power supply 102 may be operably connected to a power input and configured to produce a suitable output voltage for operation of both the lamp 104 as well as the DMX converter 106. Additionally, depending upon the arrangement of the components, the power supply 102 and DMX converter 106 may both be integrated into a single ballast/unit. Such an arrangement of the components may provide for an easier retrofit when converting an existing light fixture into an LED fixture having DMX controlled effects such as those fixtures described herein. Alternatively, the DMX controller may be integrated into another component such as the lamp itself. Such an arrangement is shown in FIGS. 2-4 as described below.

In operations, the DMX controller 108 may send one or more instructions as a DMX control signal to a network of connected devices, including the DMX converter 106 as shown in FIG. 1. The DMX converter 106 can have an associated address and, based upon that address, can determine which instructions of the DMX control signal are intended for a lighting fixture associated with that specific DMX converter. The address of DMX converter 106, for example, may be assigned or provided according to standard DMX protocol operations, or according to any additional network addressing techniques or protocols. Addressing may be performed during network installation, or at a later time to reflect changes or updates to the network. It is also possible to address the tubes by DMX auto addressing. As each tube is connected to a DMX control, the tube automatically sets its DMX address to the first available or to the next address available. The next tube that is connected will then address itself to the next available DMX address. Each additional tube will use the next available address until the universe of 512 DMX channels is filled.

After receiving the DMX control signal, the DMX converter 106 can convert the control signal into a local lamp control signal and transmit that local signal to lamp 104. For example, the local control signal may include an instruction to flash a certain color (e.g., flash red or blue), to dim, to display a combination of colors, or other similar instructions commonly received and implemented by an intelligent lighting fixture.

It should be noted that FIG. 1 includes a single lamp 104 by way of example only. A fixture may be designed such that multiple numbers of lamps are included, e.g., two or four total lamps, or more or fewer lamps. In such a fixture, the output of power supply 102 would be provided to each lamp, as would the local lamp control signal as output by the DMX converter 106. FIG. 3 provides an example of a multi-lamp fixture, and the related disclosure as included below includes additional detail.

FIG. 2 depicts a diagram illustrating a lighting fixture system 200 according to an embodiment. System 200 is similar to system 100 as shown in FIG. 1 in that an LED lamp may be retrofit in an existing fixture and modified accordingly to include DMX communications. However, in system 200, the DMX converter has been integrated as a component of the lamp, thereby further increasing the ease of retrofitting an existing light fixture.

The lighting fixture system 200 may include, for example, a power supply 202, a lamp 204, and a DMX controller 206. Similar to above, depending upon the installation of the lighting fixture, lamp 204 may be, for example, an RGB lamp or an RGBW lamp.

As shown in FIG. 2, the power supply 202 may be operably connected to a power input and configured to produce a suitable output voltage for operation of the lamp 204. Additionally, through the power connection to the lamp 204, the power supply may further provide power for the integrated DMX converter. In operation, the DMX controller 206 may send one or more instructions as a DMX control signal to a network of connected devices. As shown in FIG. 2, the DMX control signal may be transmitted directly to the lamp 204 for further processing by the integrated DMX converter. For example, the lamp may be designed and manufactured to provide an input plug or other physical connection component for operably connecting the lamp 204 and the DMX controller 206. Alternatively, the lighting fixture itself may be retrofit or otherwise designed to include an input component for establishing an operably connection between the lamp 204 (and the integrated DMX converter) and the DMX controller 206. Like before, the integrated DMX converter can have an associated address and, based upon that address, can determine which instructions of the DMX control signal are intended for the lamp the DMX converter is integrated in, e.g., lamp 204 as shown in FIG.

2. The DMX converter can then convert the control signal into a local lamp control signal for controlling operation of the lamp 204.

More specifically, the LED light tubes use an external DMX address unit. The address unit connects to the DMX input of the LED light tube. The DMX address is then selected on the address unit. Then the address unit sends the selected address to the LED light tube. The LED light tube then stores and responds to the selected DMX address. The DMX address unit can be used for all LED light tubes with internal DMX converters.

While some of the embodiments are described using a ballast, it is recognized that the system may be operated without a ballast by wiring the fixture tombstones direct to line voltage. Then the lamp will automatically switch to the correct line voltage being supplied. The DMX converter is built-in to the light tube. The light tube would not need a separate of external power supply or ballast. For retro fit applications, the ballast is by passed and not used. For new installations, the light fixture would include the frame with tombstones wired directly to line voltage. All of the electrical and DMX components can be built into the LED light tube.

FIG. 3 depicts a diagram illustrating a lighting fixture system 300 according to an embodiment that builds upon, for example, system 200 as shown in FIG. 2 by incorporating multiple lamps. The lighting fixture system 300 may include, for example, a power supply 302, multiple lamps 304*a*, 304*b* through 304*n*, and a DMX controller 306. Similar to above, depending upon the installation of the lighting fixture, lamps 304*a*, 304*b*, . . . , 304*n* may be, for example, RGB lamps, RGBW lamps or some combination thereof.

As shown in FIG. 3, the power supply 302 may be operably connected to a power input and configured to produce a suitable output voltage for operation of each of the lamps 304*a*, 304*b*, . . . , 304*n*. The power supply may power multiple low voltage LED light tubes with a large low voltage power supply. A multi-conductor cable may be used to deliver the low voltage to power the tombstones of the light fixtures and the LED light tubes.

Additionally, through the power connection to the lamp 304, the power supply may further provide power for an integrated DMX converter integrated within each of lamps 304*a*, 304*b*, . . . , 304*n*. In operation, the DMX controller 306 may send one or more instructions as a DMX control signal to a network of connected devices. As shown in FIG. 3, the DMX control signal may be transmitted directly to lamp 304*a* for further processing by the integrated DMX converter at that lamp. Additionally, the DMX converter within lamp 304*a* may be configured to output the DMX control signal to the DMX converter integrated within lamp 304*b*. Similarly, each integrated DMX converter may be configured to output the DMX control signal to another lamp. To provide for connectivity, each lamp may be designed and manufactured to provide an input plug or other physical connection component for operably connecting the lamp 304*a* and the DMX controller 306. Similarly, each lamp may also include an output plug or physical connection for operably connecting one lamp to another for transferring the DMX control signal. For example, the output of lamp 304*a* may be operably connected to the input of lamp 304*b*.

Similar to above, for each lamp, the integrated DMX converter can have an associated address and, based upon that address, can determine which instructions of the DMX control signal are intended for the lamp the DMX converter is integrated in, e.g., one of lamps 304*a*, 304*b*, . . . , 304*n* as shown in FIG. 3. The DMX converter can then convert the control signal into a local lamp control signal for controlling operation of the lamp in which it is integrated.

As shown in FIGS. 1-3, the power supplies 102, 202, 302 may be configured to receive a power input and produce an appropriate output for the various lamps and other components. Such an arrangement may be included in a low-voltage operation such as a 12 volt power system. However, the fixtures, systems and techniques as described herein may be applied to higher voltage systems as well. For example, rather than a standard power supply, an inductive ballast or a resistive ballast may be used for a higher voltage operation, such as 100-240 VAC 50/60 Hz power systems.

FIG. 4 illustrates a system 400 that includes an inductive ballast 402 for receiving a line voltage (e.g., 120 VAC at 60 Hz) and outputting appropriate power levels for operation of lamps 404*a* and 404*b*.

Similar to FIG. 3, a DMX controller 406 may send one or more instructions as a DMX control signal to a network of connected devices. As shown in FIG. 4, the DMX control signal may be transmitted directly to lamp 404*a* for further processing by the integrated DMX converter at that lamp. Additionally, the DMX converter within lamp 404*a* may be configured to output the DMX control signal to the DMX converter integrated within lamp 404*b*.

As described above, for each lamp, the integrated DMX converter can have an associated address and, based upon that address, can determine which instructions of the DMX control signal are intended for the lamp the DMX converter is integrated in, e.g., one of lamps 404*a*, 404*b* as shown in FIG. 4. The DMX converter can then convert the control signal into a local lamp control signal for controlling operation of the lamp in which it is integrated.

Absent an instruction or control signal from a DMX controller (e.g., DMX controller 108 as shown in FIG. 1), the lighting fixtures and systems as described herein may be configured to operate in a standard operating mode. In such a mode, the LED lamps may be configured to simply output a white light, or some possible color of light as determined based upon what type of LED light tube is used in construction of the lamp. For example, if the LED lamp uses RGB light tubes, absent a DMX instruction the lighting fixture may output an approximated white light as created by using a combination of the red, blue and green LEDs. Conversely, if the LED lamp uses RGBW light tubes, absent a DMX instruction the lighting fixture may output a true white light by utilizing only the white LEDs.

Additionally or alternatively, the lighting fixtures and systems and described herein may also include a local memory for storing one or more built-in programs for outputting a specific lighting pattern or effect when there is no specific DMX control signal or instruction. For example, a localized controller may load a built-in program when a DMX control signal is not present, and run the local built-in program accordingly until, for example, the program is complete or the fixture receives a new or updated DMX control signal. Similarly, multiple fixtures may be operably connected such that a common built-in program is performed by each fixture simultaneously, thereby providing integrated lighting effects without a specific DMX control signal.

Figure 5:
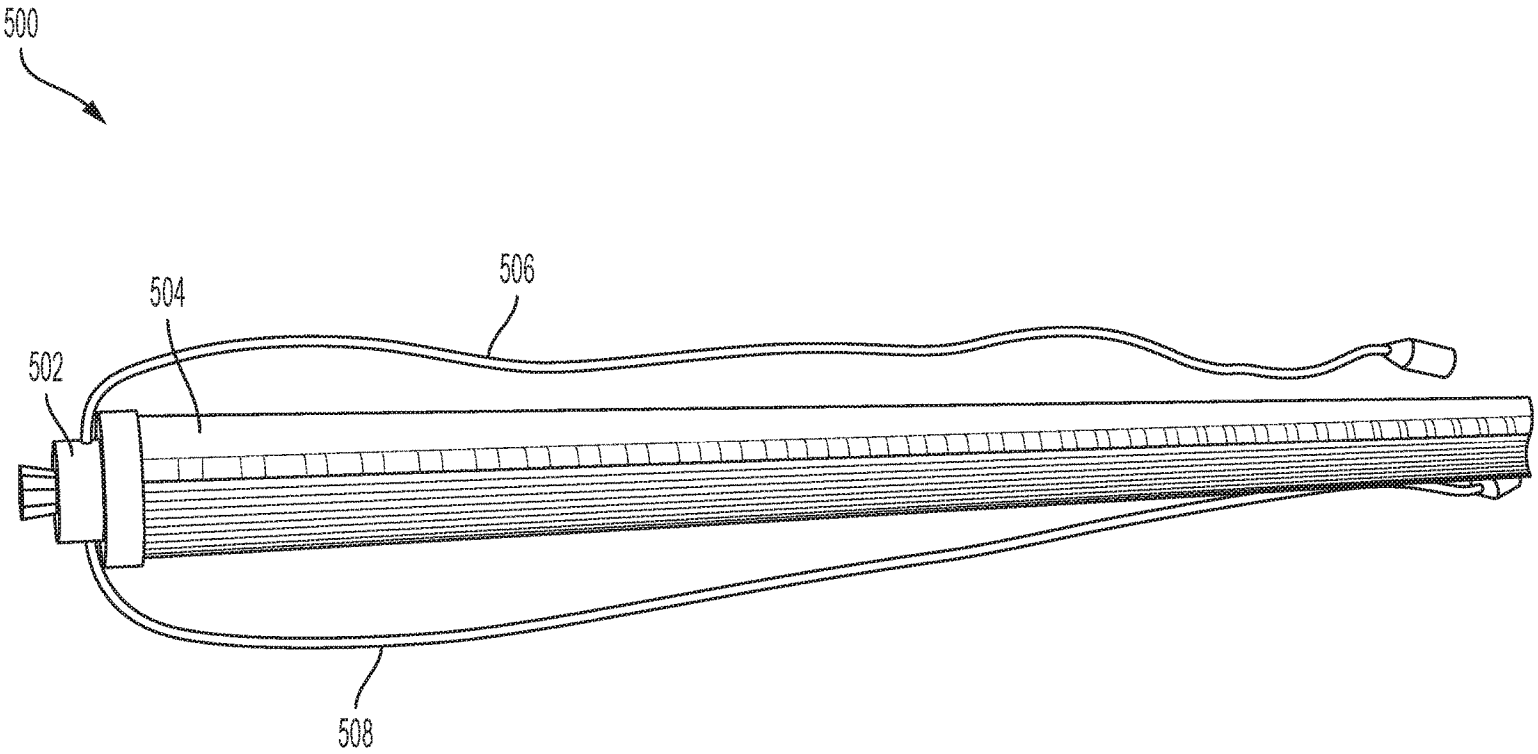
FIG. 5 depicts a sample lamp according to an embodiment.

FIG. 5 illustrates a sample lamp 500 for use in a fixture as described herein. For example, the lamp 500 may be incorporated into one or more of systems 100, 200, 300 and 400 as shown in FIGS. 1-4 and described above. The lamp 500 includes a base 502 configured to establish a connection between the fixture the lamp is installed in and the lamp itself, thereby providing power to the lamp for illuminating a light tube 504 of the lamp. As described above, the light tube 504 may include one or more LED light strip combinations including, for example, RGB or RGBW LEDs, or any LED combinations described herein.

According to one or more embodiments as described herein, the base 502 may also include a local DMX converter, similar to the local DMX converter as shown in lamp 204 of FIG. 2. The local DMX converter may receive a DMX control signal via a DMX input line 506 and process the control signal to determine if the control signal is intended for lamp 500. If the local DMX converter determines the control signal is intended for lamp 500 (e.g., via a comparison of addressing information contained within the DMX control signal), the local DMX converter may further process the control signal to determine what effect the lamp 500 is being instructed to output. The local DMX converter can output the local DMX control signal to one or more additional lamps via a DMX output line 508. As described above, absent a DMX instruction the lamp 500 may output a true white light by utilizing only the white LEDs (if available).

Additionally or alternatively, a lamp such as lamp 500 may include ultraviolet (UV) LEDs. For example, the white LEDs (e.g., in a RGBW lamp) can be replaced by UV LEDs. In another example, UV LEDs may be added to an existing lamp rather than replace one or more of the existing colored LEDs from the lamp. UV LEDs may be incorporated into a lamp, and thus a light fixture, to provide additional lighting techniques such as a black light, thereby providing decorative and artistic lighting effects. Additionally, UV LEDs may be used in concert with fluorescent dyes, fabrics and other materials to provide additional lighting effects.

Figure 6:
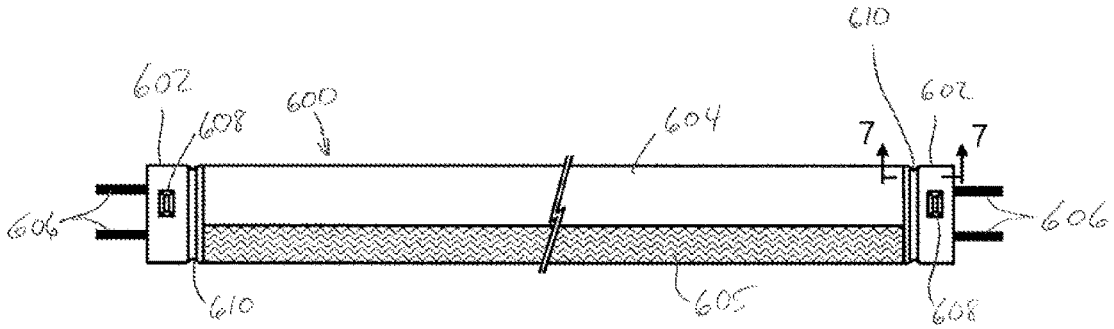
FIG. 6 depicts a sample lamp according to another exemplary embodiment.
Figure 7:
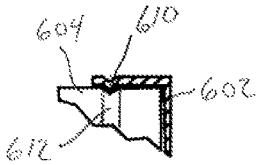
FIG. 7 is a cross-sectional view along the line 7-7 in FIG. 6.

Referring to FIGS. 6 and 7, another emplary lamp 600 for use in a fixture as described herein. For example, the lamp 600 may be incorporated into one or more of systems 100, 200, 300 and 400 as shown in FIGS. 1-4 and described above. The lamp 600 includes opposed bases 602 configured to establish a connection, for example, via the input pins 606, between the fixture the lamp is installed in and the lamp itself, thereby providing power to the lamp for illuminating a light tube 604 of the lamp. As described above, the light tube 604 may include one or more LED light strips including, for example, RGB, RGB-W, RGB-UV, RGB-IR, RGB-A, RGB-W-UV, RGB-W-IR, RGB-UV-IR, UV-IR, W-UV, W-IR, W-UV-IR, RGB-UV-IR-W, W-A, RGB-A-IR-W or any combination. Similar to base 502, the base 602 may also include a local DMX converter, similar to the local DMX converter as shown in lamp 204 of FIG. 2.

Each base 602 is configured to be rotatable for beam focus and adjustable relative to the light tube 604. In the illustrated embodiment, each base 602 includes an inwardly extending detent 610 configured to engage a corresponding groove 612 on the light tube 604 such that the components are interconnected but rotatable relative to one another. Other mechanisms for rotatable interconnection may alternatively be utilized. When the tube is installed, the input pins are lined up with the tombstones and then the bases 602, instead of the entire lamp, are rotated and secured in the tombstones. Each base 602 may include a tab 608 or the like to assist with twisting thereof. By having adjustable bases 602, the tubes and lens 605, if included, can be easily focused and the beam angle adjusted for each of the tubes 604. It is further contemplated that the lenses 605 may be interchangeable for various size beams.

For each of the embodiments described herein, the lamps 104, 204, 304, 404, 500, 600 may have light tubes of standard size or custom size. For example, the lamps may be manufactured in standard diameters of T2 to T17 with standard lengths of, for example, 15 inches, 18 inches, 24 inches, 36 inches or 48 inches. The lamps may also be manufactured with larger diameters and different lengths, for example, lengths intermediate of the standard lengths or lengths longer than the standard lengths, for example, 96 inches or more. The larger diameter tubes may be utilized to provide multiple rows of various types of led nodes. The larger tubes may also facilitate lamps with increased wattage. The lamps may also have configurations other than the illustrated linear configurations. For example, the lamps may have U-shaped or circular configurations. Also, the lamps may be manufactured with single, dual or further configurations of pins for input of electrical power.

It should be noted that each of FIGS. 1-4 illustrates a single fixture for illustrative purposes only. Additionally, multiple fixtures may be arranged into a network of connected devices. For example, as shown in FIG. 1, DMX controller 108 may provide a DMX control signal to another light fixture. Such a communication may be a wired connection according to standard DMX protocols. Alternatively, the connection may be a wireless connection using standard wireless communication protocols such as mesh networking protocols. In such an arrangement, one or more fixtures may communicate with multiple other fixtures simultaneously, thereby providing redundant wireless communication links between the fixtures should one or more links fail (e.g., if a fixture loses power for some reason).

Various of the above-disclosed and other features and functions, or alternatives thereof, can be combined into many other different systems or applications. Various presently unforeseen or unanticipated alternatives, modifications, variations or improvements therein can be subsequently made by those skilled in the art, each of which is also intended to be encompassed by the disclosed embodiments.

The invention claimed is:

1. A light emitting diode (LED) lighting fixture, comprising:

a lamp including a tube with at least one LED lamp positioned therein, and first and second bases respectively coupled to opposing ends of the tube, at least one of the first and second bases configured to facilitate (1) establishment of an electrical connection between the lamp and an external fixture, (2) an adjustment of a beam angle for the tube, and (3) control of the lamp in accordance with instructions received from an external communication protocol controller, where the lamp has at least one communication protocol address associated therewith; and a communication protocol converter integrated with one of the first and second bases of the lamp, the communication protocol converter configured to receive an instruction from the external communication protocol controller, determine if the instruction is intended for the associated at least one communication protocol address, and if so, control the at least one LED lamp based on the instruction.

2. The LED lighting fixture according to claim 1, wherein a communication protocol employed by the communication protocol converter is selected from digital multiplex (DMX), attached resource computer network (ARCnet), Ethernet (IEEE 802 protocols), infrared (IR), or serial communication.

3. The LED lighting fixture according to claim 1, wherein the LED lamp includes one or more of the colors red(R), green(G), blue(B), white(W), ultra-violet(UV), amber (A) and infrared (IR).

4. The LED lighting fixture according to claim 3, wherein the LED lamp colors include one or more of combinations of RGB, RGB-W, RGB-UV, RGB-IR, RGB-A, RGB-W-UV, RGB-W-IR, RGB-W-A, RGB-UV-IR, UV-IR, W-UV, W-IR, W-A, W-UV-IR, RGB-LTV-IR-W, or RGB-A-IR-W.

5. The LED lighting fixture according to claim 1, wherein the LED lamp includes a plurality of pixels or segments, and a mode may be selected which allows given subsets of the pixels or segments to be controlled independently at one time.

6. The LED lighting fixture according to claim 5, wherein each given subset has a communication protocol address associated therewith.

7. The LED lighting fixture according to claim 1, wherein the communication protocol converter generates a local lamp control signal and sends it to the at least one LED lamp when the instruction is intended for the associated at least one communication protocol address.

8. The LED lighting fixture according to claim 1, wherein the communication protocol converter has an input configured to receive input signals including the instructions from the communication protocol controller.

9. The LED lighting fixture according to claim 8, wherein the communication protocol converter has an output configured to output signals to a downstream communication protocol converter.

10. The LED lighting fixture according to claim 1, wherein each of the first and second bases comprises external electrical contacts, and the tube is rotatable relative to the first and second bases.

11. The LED lighting fixture according to claim 10, wherein each of the first and second bases includes an inwardly extending detent which engages a corresponding groove on a respective end of the tube.

12. The LED lighting fixture according to claim 10, wherein each of the first and second bases includes a tab configured for engagement to rotate the respective base relative to the tube.

13. The LED lighting fixture according to claim 10, wherein the tube includes a lens, and the orientation of the lens relative to the first and second bases may be adjusted by rotating the tube relative to the first and second bases.

14. The LED lighting fixture according to claim 13, wherein the lens is interchangeable to produce various sized beams.

15. The LED lighting fixture according to claim 1, wherein the lamp has a standard diameter within the range of T2 to T17.

16. The LED lighting fixture according to claim 1, wherein the lamp has a length selected from 15 inches, 18 inches, 24 inches, 36 inches, 48 inches and 96 inches.

17. The LED lighting fixture according to claim 1, wherein the tube has a circular or U-shaped configuration.

18. The LED lighting fixture according to claim 1, wherein the lamp is configured to operate the at least one LED lamp in a standard operating mode when no signal is received from the communication protocol converter.

19. The LED lighting fixture according to claim 18, wherein the standard operating mode is to produce white light.

20. The LED lighting fixture according to claim 18, wherein the standard operating mode includes a lighting pattern or effect which is stored in a local memory.

21. An communication protocol network comprising:

at least one communication protocol controller;

an LED lighting fixture according to claim 1 associated with the at least one communication protocol controller such that the communication protocol converter associated with the lamp of the LED lighting fixture receives signals from the communication protocol controller; and at least one other device associated with the at least one communication protocol controller such that a communication protocol converter associated with the other device receives signals from the communication protocol controller and acts in accordance with instructions delivered thereto via the signals.

22. The communication protocol network according to claim 21, wherein the at least one other device is a second LED lighting fixture.

23. The communication protocol network according to claim 21, wherein the at least one other device is selected from an audio output, a fog machine and an intelligent light.

24. A light emitting diode (LED) lighting fixture, comprising:

a lamp including a tube with at least one LED lamp positioned therein, and first and second bases respectively coupled to opposing ends of the tube, at least one of the first and second bases configured to facilitate (1) establishment of an electrical connection between the lamp and an external fixture, and (2) control of the lamp in accordance with instructions received from an external communication protocol controller, where the lamp has at least one communication protocol address associated therewith; and a communication protocol converter integrated with one of the first and second bases of the lamp, the communication protocol converter configured to receive an instruction from the external communication protocol controller, determine if the instruction is intended for the associated at least one communication protocol address, and if so, control the at least one LED lamp based on the instruction.

* * * * *